US007883341B2

(12) United States Patent
Lang et al.

(10) Patent No.: US 7,883,341 B2
(45) Date of Patent: Feb. 8, 2011

(54) MODULAR CONNECTOR WITH EMI PROTECTION

(75) Inventors: Harold Keith Lang, Cary, IL (US); Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 30 days.

(21) Appl. No.: 12/342,369

(22) Filed: Dec. 23, 2008

(65) Prior Publication Data

US 2010/0130063 A1 May 27, 2010

Related U.S. Application Data

(60) Provisional application No. 61/116,885, filed on Nov. 21, 2008.

(51) Int. Cl.
*H01R 12/00* (2006.01)

(52) U.S. Cl. ..... 439/76.1; 439/465; 439/731

(58) Field of Classification Search ..... 439/76.1, 439/350–358, 465, 731
See application file for complete search history.

(56) References Cited

U.S. PATENT DOCUMENTS

| | | | | |
|---|---|---|---|---|
| 6,210,178 | B1 * | 4/2001 | DeForest, Jr. | 439/76.1 |
| 6,549,426 | B1 * | 4/2003 | Lawlyes et al. | 361/816 |
| 6,729,897 | B2 * | 5/2004 | Lai | 439/347 |
| 7,052,295 | B1 * | 5/2006 | Lin | 439/159 |
| 7,160,135 | B1 * | 1/2007 | Wu | 439/352 |
| 7,371,119 | B1 * | 5/2008 | Lee | 439/630 |
| 7,410,376 | B2 * | 8/2008 | Ying et al. | 439/159 |

* cited by examiner

*Primary Examiner*—Thanh-Tam T Le
(74) *Attorney, Agent, or Firm*—Stephen L. Sheldon

(57) ABSTRACT

A connector includes a first and second housing that are configured to be coupled together. The connector may include two circuit cards supported by card supports. Mating edges of the first and second housing are configured to be coupled together and may include one or more crushed ribs positioned in an elongated channel/elongated shoulder interface. The one or more crushed ribs may be configured so as to be spaced apart a distance that acts to improve the electrical shielding provided by the connector. The connector may be configured to be coupled to a cable.

22 Claims, 18 Drawing Sheets

FIG.4
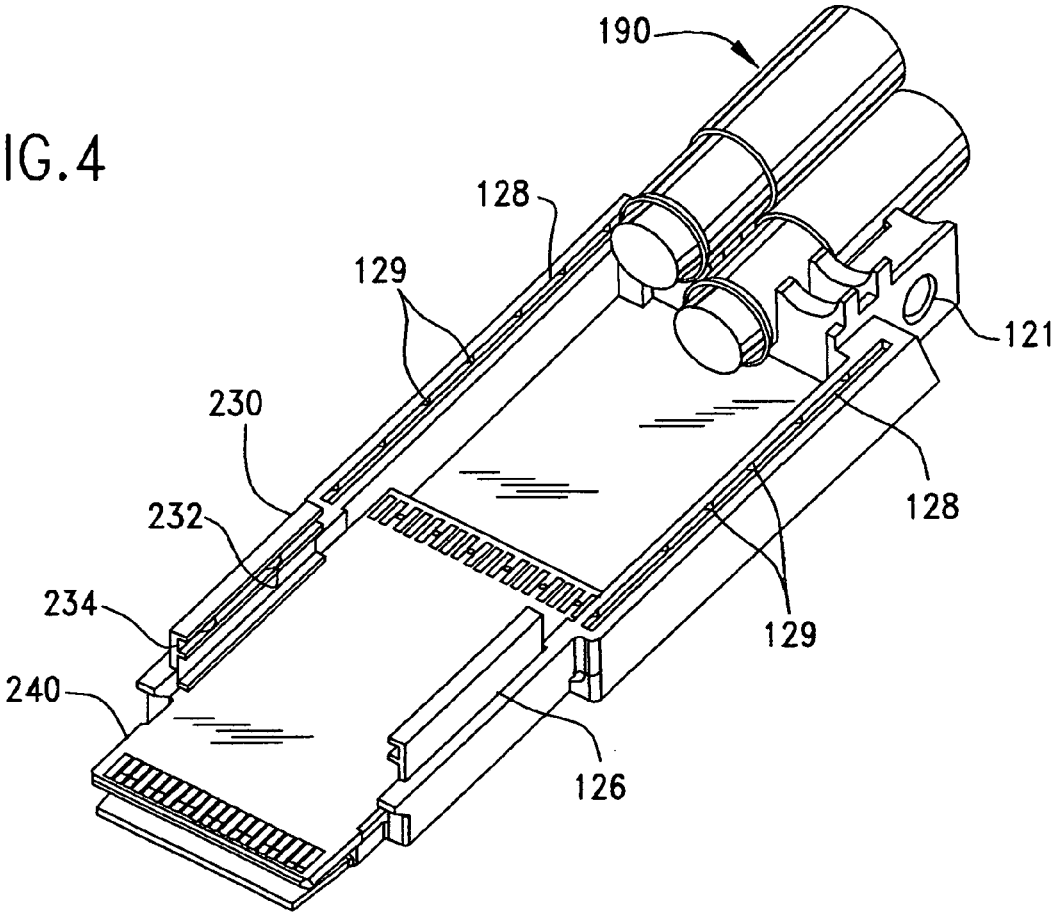
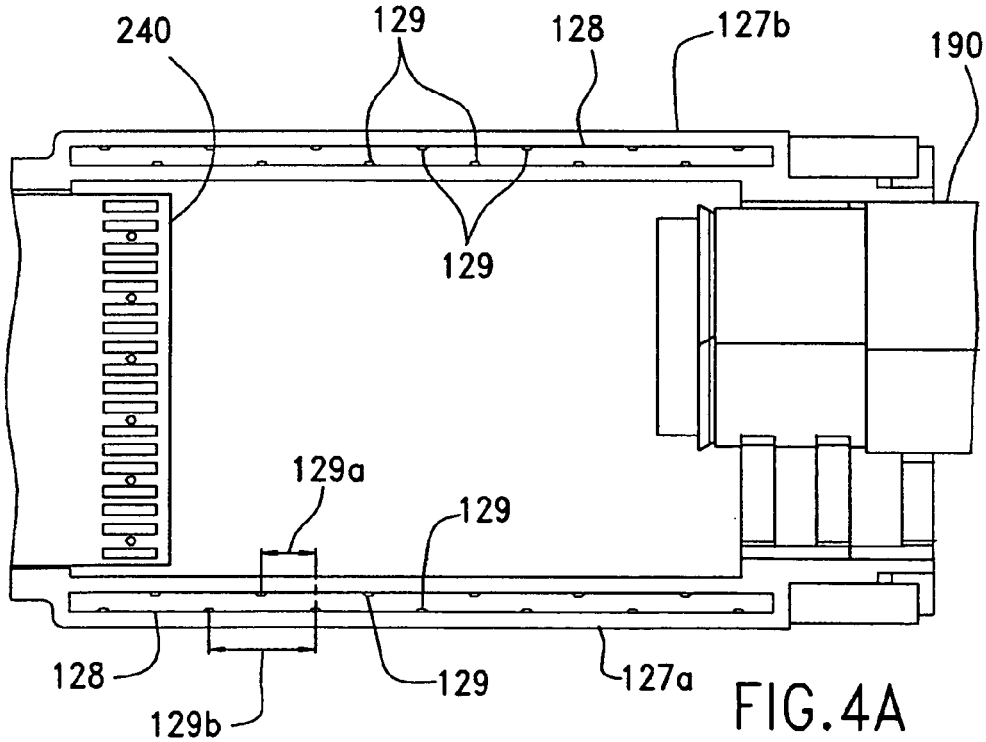
FIG.4A

MODULAR CONNECTOR WITH EMI PROTECTION

RELATED APPLICATIONS

This application claims priority to Provisional Application Ser. No. 61/116,885, filed Nov. 21, 2008, which is incorporated by reference in its entirety herein.

BACKGROUND OF THE INVENTION

1. Field of the Invention

The present invention relates to the field of connectors, more specifically to connectors suitable for use in high-speed data communication.

2. Description of Related Art

High-speed connectors are known and while a number of configurations exist, they typically include multiple high-speed data paths that allow two components to communicate together. One version of a high-speed connector is a plug connector and a receptacle connector that mate together. While different version are possible, one plug connectors that is known and has been used in standard connector designs is the SFP plug connector design compatible with the SFF Committee INF-8074i specification for SFP (Small Form factor Pluggable) Transceiver. While the overall shape of the connector has proven satisfactory for a number of uses, changes in technology have created a demand for a connector with improved performance. One method of addressing this demand is to make the connector wider, thus increasing the number of data channels. Unfortunately, the additional width takes up more space and inhibits the ability to make the components (and the resulting products) more compact. Therefore, increasing the effective speed of the data channels becomes more desirable. In general, increasing the data rate requires using either more complex signaling encoding (e.g., going from NRZ to PAM-5 encoding) or using higher frequencies to increase the effective data rate. It has been determined that existing connector designs are not well suited to provide these higher level performance levels, therefore improvements in the connector design would be appreciated.

BRIEF SUMMARY OF THE INVENTION

A connector includes a first and second housing that are configured to be coupled together. The first housing may include a first slot extending along a first edge and the second housing may include a first shoulder configured to be inserted into the first slot. The first slot includes one or more spaced apart ribs that are configured to be deformed upon insertion of the first elongated shoulder into the slot. The connector may include a second edge on one of the first and the second housing with a corresponding shoulder on the other of the first and second housing. The connector may include one or more circuit cards positioned within an internal cavity defined by the first and second housing.

BRIEF DESCRIPTION OF THE DRAWINGS

The present invention is illustrated by way of example and not limited in the accompanying figures in which like reference numerals indicate similar elements and in which:

FIG. 4 illustrates a further simplified view of the partial connector depicted in FIG. 3.

FIG. 4*a* illustrates a partial elevated top view of the connector depicted in FIG. 4.

DETAILED DESCRIPTION OF THE INVENTION

Figure 1:
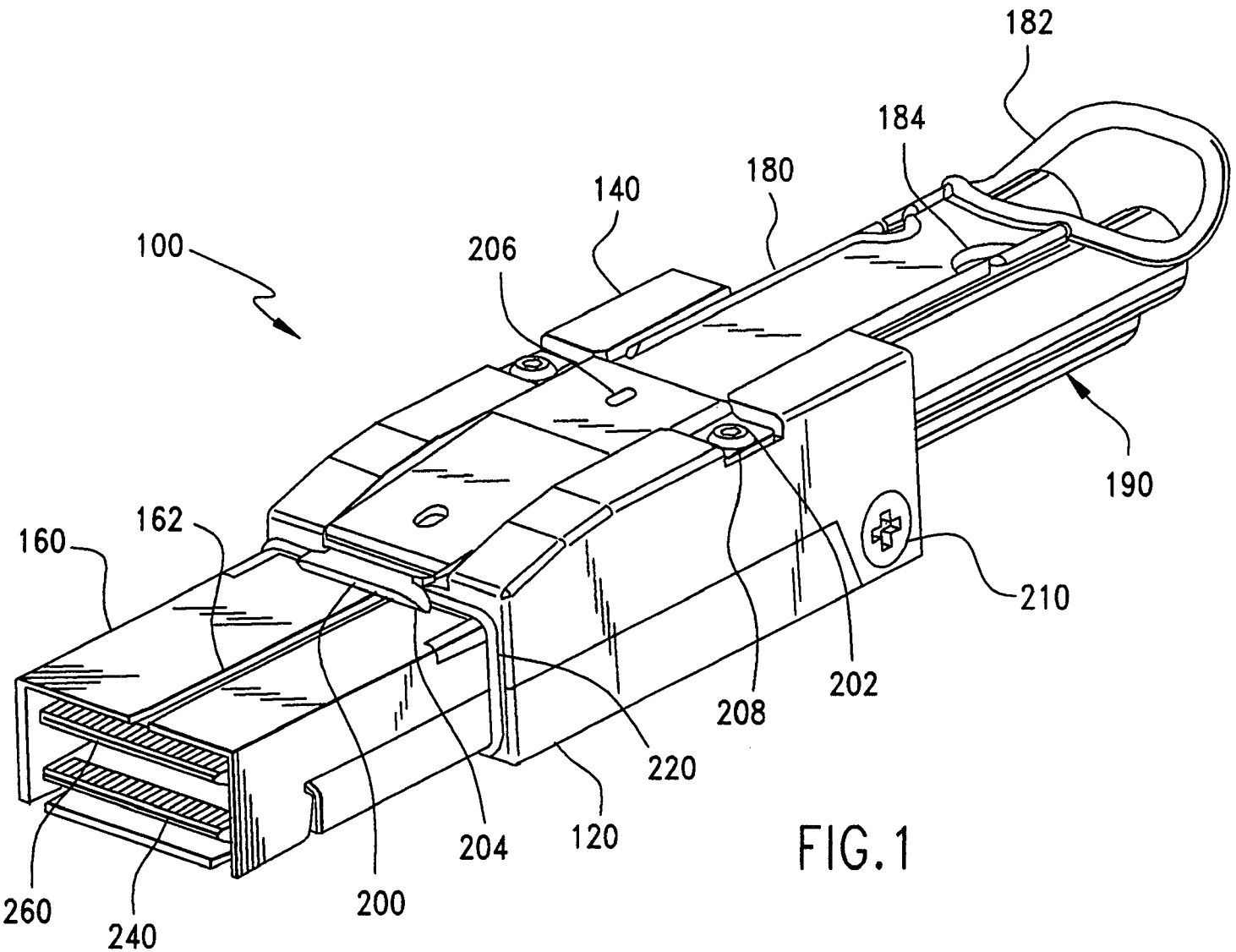
FIG. 1 illustrates a perspective view of an embodiment of a connector configured to be coupled to three cables.

Conductive housings for connectors are known and have been used to shield the internal components of the connectors. As the frequency has increased, the associated wavelengths of interest have decreased. Unfortunately, at high frequencies the wavelengths are so short that even the relatively flat sections of two mating portions of a housing will have sufficient gaps so as to fail to prevent electromagnetic interference (EMI) from entering. Therefore, it has become more problematic to couple two housings together in a manner that provides effective EMI shielding. While the use of a conductive gasket is possible, gaskets increase the piece count of the component, as well as the complexity of assembly. It has been determined that the use of period crush ribs, as will be discussed below, can help improve the EMI shielding in a manner not previously attempted.

Looking first at FIGS. 1-12, features of an embodiment of a connector 100 are depicted. The connector 100 includes a first housing 120 and a second housing 140 that are coupled together via a fastener 210. When coupled together, the first and second housing 120, 140 define an internal cavity 105 (FIG. 14*a*) that can be used to hold and help protect components mounted therein from EMI and/or physical damage. It should be noted that configurations disclosed illustrate embodiments of a connector coupled to one or more cables, however a number of the features depicted herein are also suitable for use with connectors coupled to an optical module that in turn is coupled to optical fiber(s).

The first and second housing 120, 140 cooperate to form a plug portion 160 that includes an opening 161 that leads to a channel 162. As depicted, within the plug portion 160 a first circuit card 240 and a second circuit card 260 are positioned and may be supported by card support 230. A pull latch 180 is mounted to the second housing 140 in a latch groove 142 and is secured in place via a retaining member 200. A wire set 190 is coupled to the first and second housing 120, 140 and the pull latch 180 may be secured to the wire set 190 via a retention band 110. A conductive gasket 220 may be positioned around the plug portion 160 to assist in forming a conductive seal with a corresponding receptacle (not shown).

The wire set 190 may comprise one or more cables with an insulation layer 191 surrounding a shield 192, which in turn surrounds a bundle of conductive elements 194 (typically a number small gauge, insulated wires but shown as a single member for ease of illustration). The first and second housing 120, 140 include a shield support 320 and an insulation support 324 to respectively support and secure the shield 192 and the insulation 191. If desired, the shield support 320, which may comprise two spaced apart curved retaining fingers 122 on the first housing 120 opposing two curved fingers 150 on the second housing 140, can be configured to grip the shield 192 securely. In an embodiment, the curved retaining fingers can be two spaced apart parallel curved members. To avoid excessive compression of the wire set 190, a ferrule 193 maybe inserted under the shield 192 so that when the first and second housing 120, 140 are coupled together, the shield support 320 grips the shield 192 and pinches the shield 192 between the shield support 320 and the ferrule 193. Similarly, gripping portions 130, 152 can be used to retain the insulation layer 191 (although the gripping portions 130, 152 can be configured to provide less compression as the ferrule typically isn't inserted that far into the cable). As can be appreciated, this allows the connector 100 to retain the wire set 190 by gripping the shield(s), which typically is the portion of the cable that is most desirable to and therefore are most suitable for use in retaining the cable in the event a force is exerted on the cable that acts to pull the cable out of the connector.

As depicted, the wire set 190 can comprise three cables, each with a plurality of conductive elements bundled inside if there is desire to split the signal channels (discussed below) into three groups. In an alternative embodiment, some other number of cables, such as 1 or two or four or more cables, may be used if all the data channels are to be directed to differently (e.g., to different receptacles) or if greater flexibility is desired. An advantage of the depicted configuration is that it allows three cables to be coupled in a housing while still allowing the connector to be inserted into a ganged or stacked or ganged and stacked receptacle array. Without such a configuration, the connector size would likely grow and consequentially cause the size of the corresponding receptacle array to also grow.

Figure 1A:
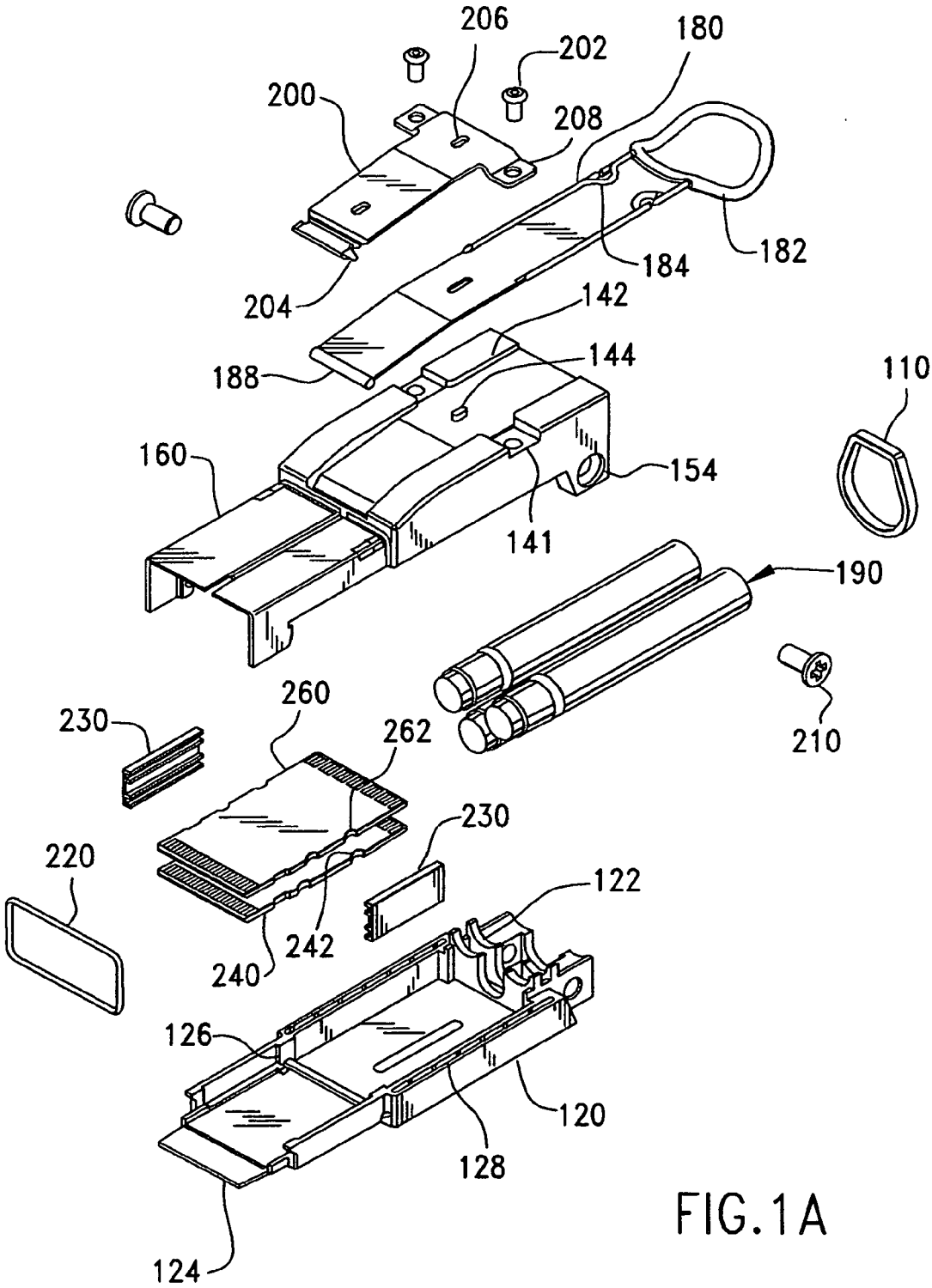
FIG. 1A illustrates an exploded perspective view of an embodiment of a connector such as is depicted in FIG. 1.
Figure 2:
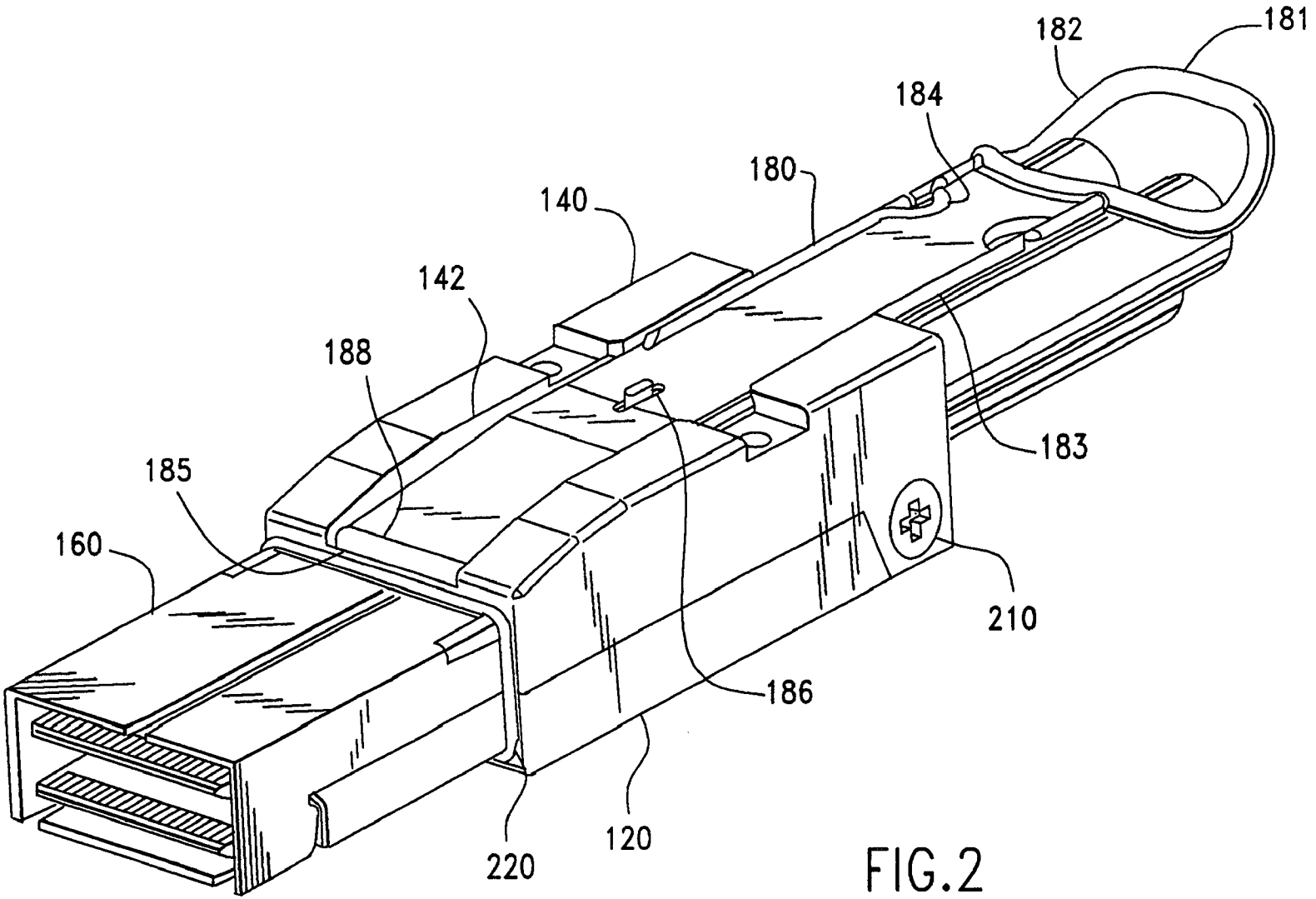
FIG. 2 illustrates a partial perspective view of the connector depicted in FIG. 1.
Figure 2A:
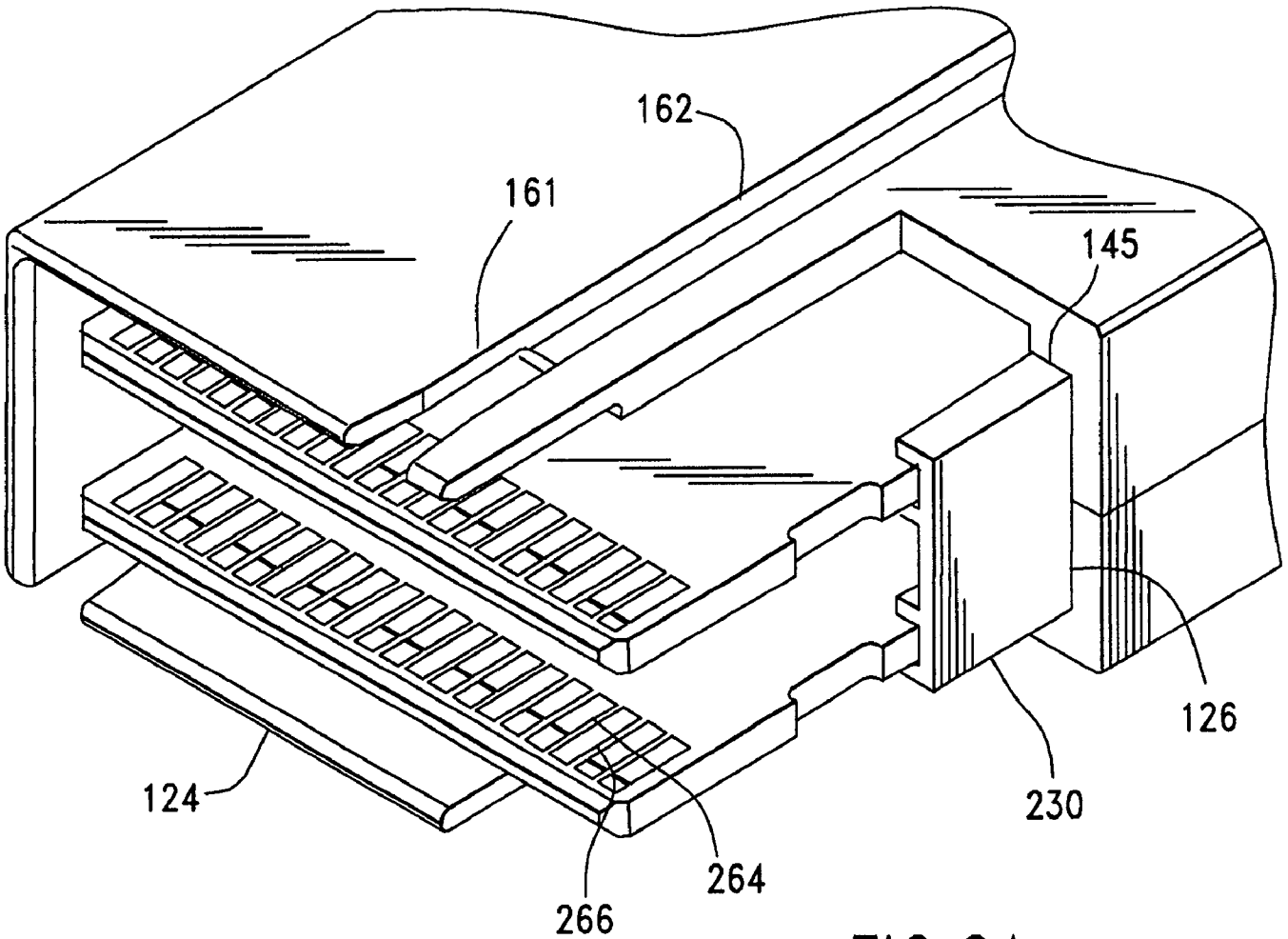
FIG. 2A illustrates a partial cut-away view of connector depicted in FIG. 2.
Figure 3:
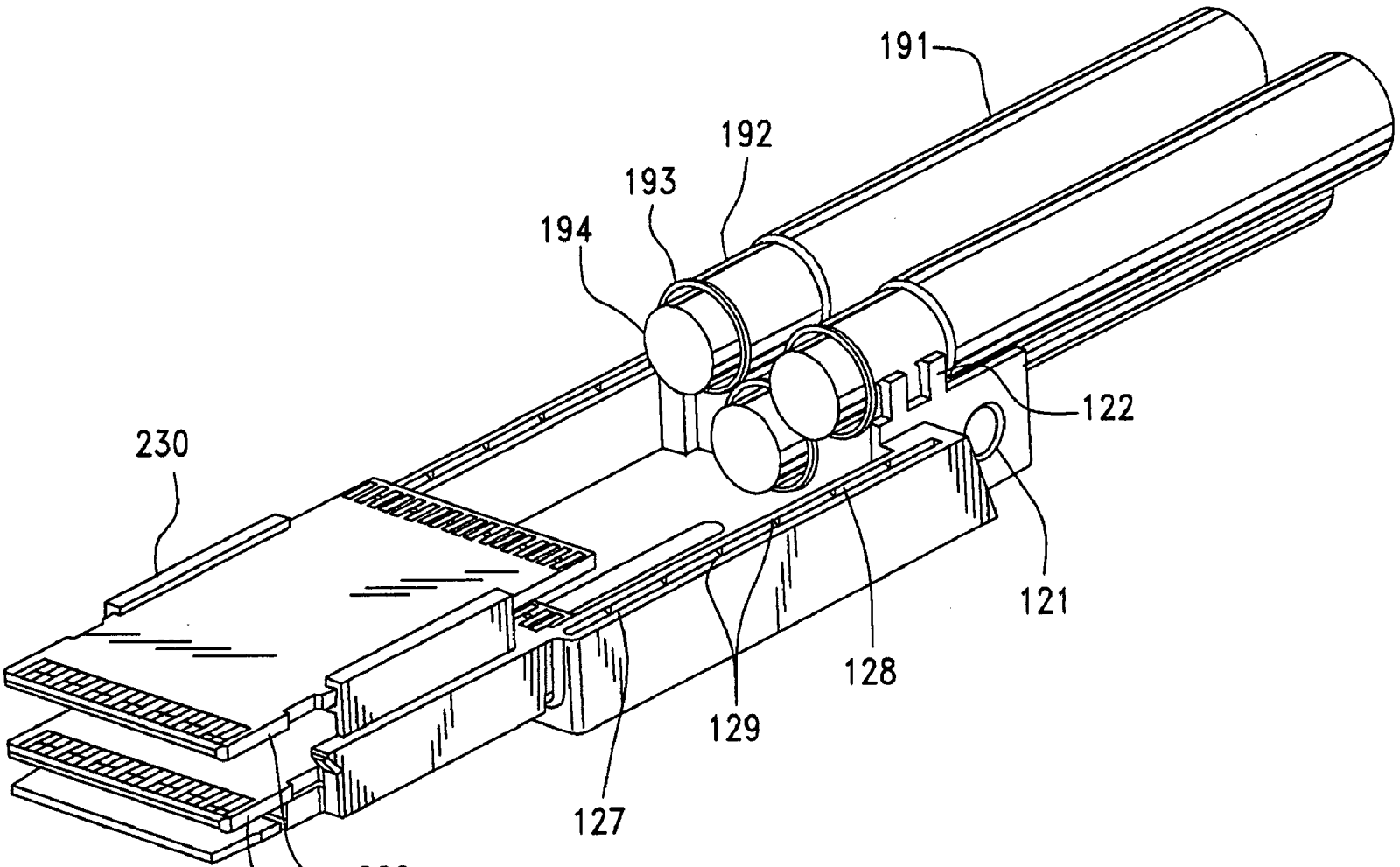
FIG. 3 illustrates a partial view of the connector depicted in FIG. 1 with an upper housing removed.
Figure 5:
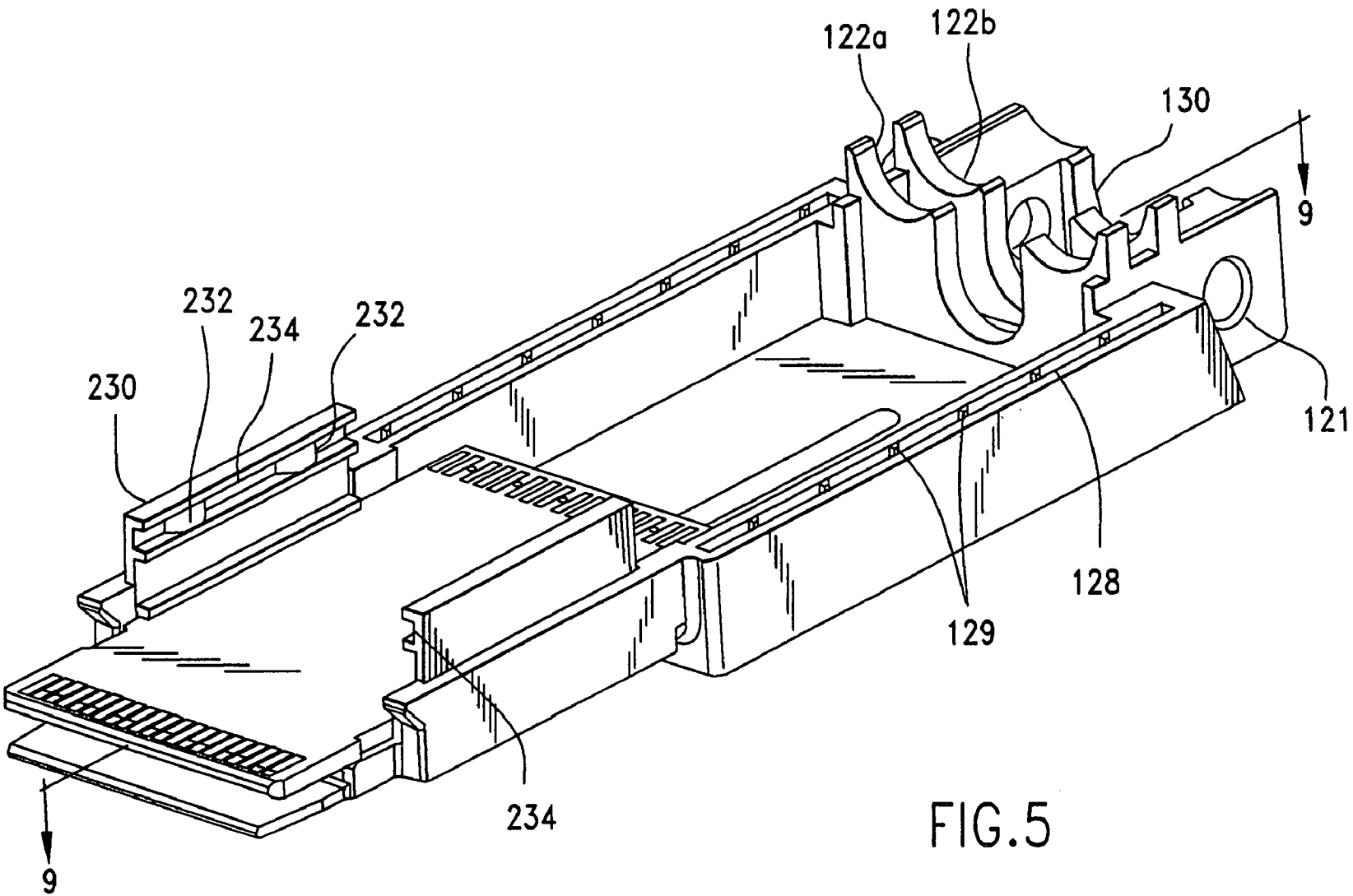
FIG. 5 illustrates a further simplified view of the partial connector depicted in FIG. 4.

As can be appreciated from FIGS. 1A and 2, for example, the second housing 140 includes a projection 144 that is positioned in slot 186. The size of the slot controls the distance the pull-tab 180 can translate and allows the pull tab 180 to be held by a gripping feature 182 on end 181 and pulled so that ramp 188, which may be positioned on end 185, causes retaining features 204 of retaining member 200 to translate. In operation, retaining features 204 can engage corresponding features on a receptacle (not shown) and the retaining features 204 can be configured to prevent removal of the connector 100 from the receptacle unless the pull tab 180 is actuated. It should be noted that the location of the ramp is not critical but instead can be positioned as desired so long as it is capable of translating the retaining features 204 to a disengaging position.

The retaining member 200 is depicted as being secured to the housing 140 by fasteners 202 that secure wing 208 to the second housing 140. As discussed below, however, other methods of securing the retaining member 200 are contemplated and may provide certain advantages.

Figure 21:
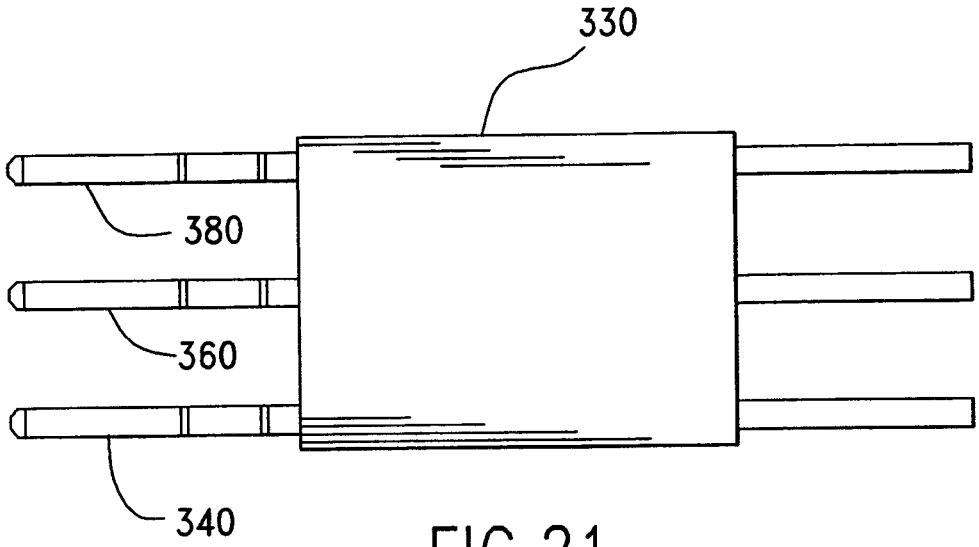
FIG. 21 illustrates an elevated side view of an embodiment of a card support assembly.
Figure 22:
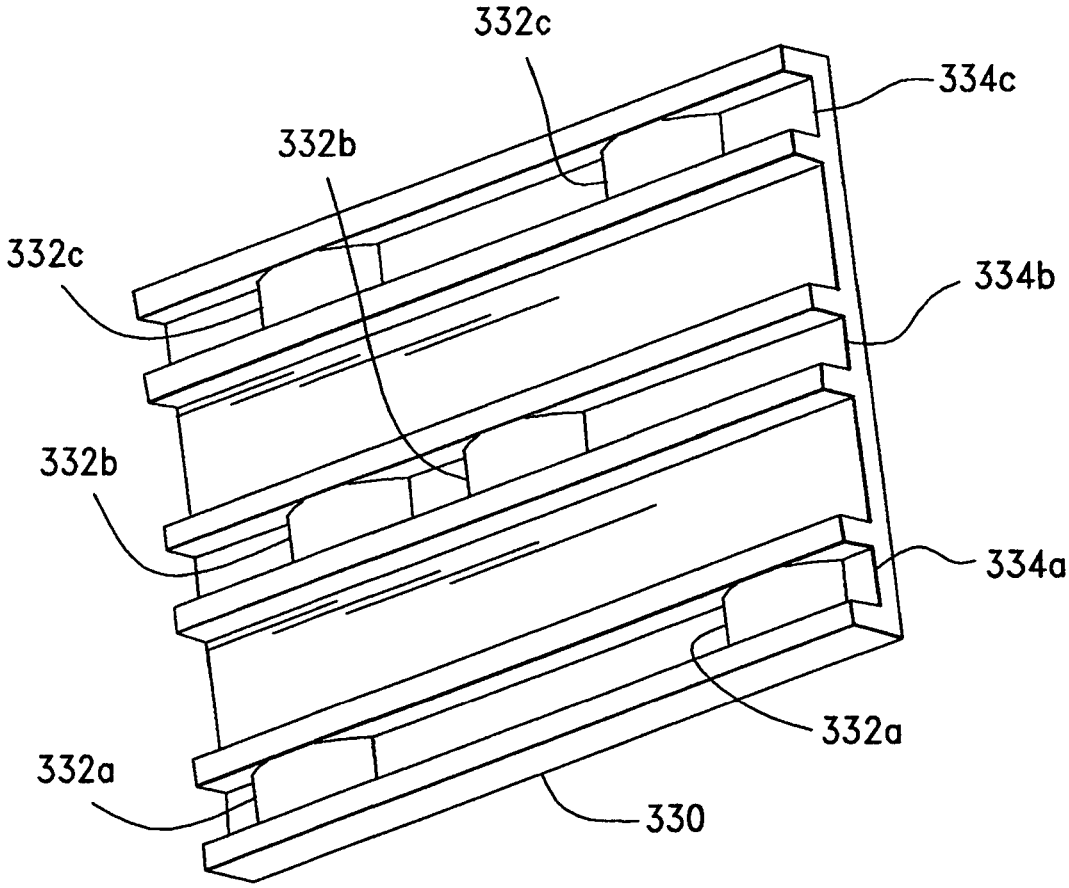
FIG. 22 illustrates a perspective view of an embodiment of a card support.

As noted above, circuit cards 240, 260 may be supported within the plug portion 160 by the card support 230. In an alternative embodiment (not shown) the first and second housing can include support structure that is integral to the housing. For example, the first and second housing may have retaining features formed in the location where the notches are provided in FIG. 1*a*. An advantage of using card support 230 is that an improved tolerance for the skew between the two adjacent circuit cards is possible. In other words, the card support 230 makes it easier to ensure that multiple circuit cards are in parallel alignment, particularly if the number of cards increases to three or more. In an embodiment, a first card support 230 is positioned in notch 126 and notch 145 (which collectively form a card support socket) and a second card support is position on the other side of the circuit cards 240, 260 in a similar card support socket. The circuit cards include traces that in an embodiment may be configured for a pre-set ground and signal configuration (e.g., the location of the grounds and signals are predetermined). For example, the circuit card may include a repeating ground, signal, signal pattern. As can be appreciated, three or more cards can be aligned in a similar manner, such as is depicted in FIGS. 21-22. Thus, this disclosure is not intended to be limiting in this respect.

The first housing 120 includes a first edge 127 that is configured to mate with a second edge 148 on the second housing 140. To provide superior shielding, the first edge includes an elongated slot 128 configured to mate with an elongated shoulder 146. As pictured, the elongated slot 128 extends a substantial portion of the housing between the plug portion and the opposite end. Furthermore, the elongated slot 128 extends substantially along the entire first edge 127.

The elongated slot and elongated shoulder help seal the first and second housing together. However, as the frequency of signal being transfer over the connector increases, the wavelengths of interest have decreased. Consequentially, it has become difficult to provide a surface that is sufficiently flat so as to electrically seal the first and second housing 120, 140 together for the frequencies of interest. It has been determined if ribs 129 are included at periodic spaces such as space 129*a* or space 129*b* in the elongated slot 128, the insertion of the elongated shoulder 146 into the elongated slot 128 will cause the elongated shoulder 146 to engage the ribs 129 and deform them (or crush them). This forced displacement helps ensure that a reliable electrical connection occurs at a predetermined spacing—thus allowing the first and second housing to provide the desired EMI shielding. This also has the advantage of allowing the frequency of ribs (e.g., the spacing between adjacent ribs) to be set so as to control the insertion force required to insert the elongated shoulder 146 into the elongated slot 128. In an embodiment, the spacing between ribs (whether on the same or opposite sides) may be between about 2-3 mm. If a reduced engagement force is desired, the ribs may be spaced between 4-6 mm (although this will naturally allow longer wavelengths to pass through the section between the ribs).

In an embodiment, the ribs 129 may be placed on both sides of the elongated slot 128 in an alternating pattern, as depicted in FIG. 4*a*. In such an embodiment, the ribs may extend into the elongated slot 128 between about 10 and 26 percent of a width of the elongated slot 128, the distance being controlled by, among other things, the desired insertion force, the material properties, the ability to control tolerances and the number of ribs being used. In an embodiment, the sum of the extension of the ribs 129 into the elongated slot 128 is between 30 and 40 percent (e.g., about 15 to 20 percent on each side). As can be appreciated from FIG. 4A, an advantage to having ribs on both sides of the channel is that the forces resisting the crushing of the ribs are somewhat balanced out, thus the engagement of the elongated shoulder 146 into the elongated slot 128 has less of a tendency to deform the connector housings when the first and second housing 120, 140 are coupled together.

In an alternative embodiment, the ribs 129 on the inside or the outside may be omitted so that ribs 129 are only provided on one side of the elongated slot 128 (such as on the outside or the inside of both elongated slots 128). As can be appreciated, including ribs on only one side of the slot can allow for larger ribs and thus allow for more deformation of individual ribs.

Figure 23:
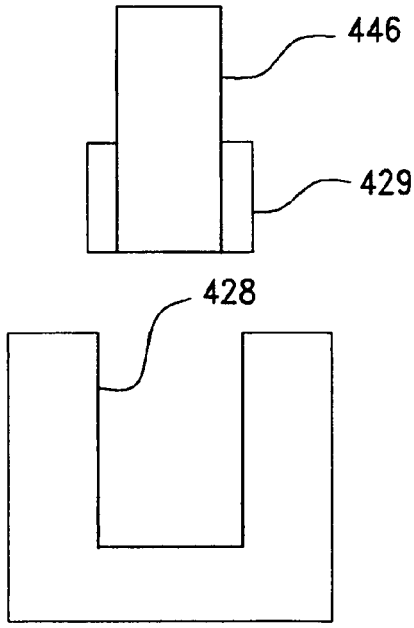
FIG. 23 illustrates a simplified schematic view of an embodiment of an elongated shoulder and an elongated slot configured to be coupled together.

It should be noted that in another embodiment, ribs 429 may be placed on the elongated shoulder 446 and inserted into an elongated slot 428 (FIG. 23). Thus, unless otherwise noted, the location of the ribs and the position of the ribs (whether in the channel or the shoulder) can be modified as desired to provide the desired EMI shielding. For example, one or more ribs could be placed on both an elongated shoulder and an elongated slot so as to provide a plurality of crushed ribs between the elongated slot and the elongated shoulder.

The spacing (129*a*, 129*b*) between ribs 129 (whether ribs 129 are on one side or on both sides of the elongated slot 128) can be set small enough so that insertion of the shoulder 146 crushes the ribs 129 often enough to create an conductive shield that block spurious signals in the frequency range of interest. In an embodiment, the ribs may have a uniform spacing that is equivalent to a wavelength for a signal at 3/2 the frequency of the Nyquist frequency (which for NRZ signaling is about X/2 GHz for X Gbps performance).

Figure 13:
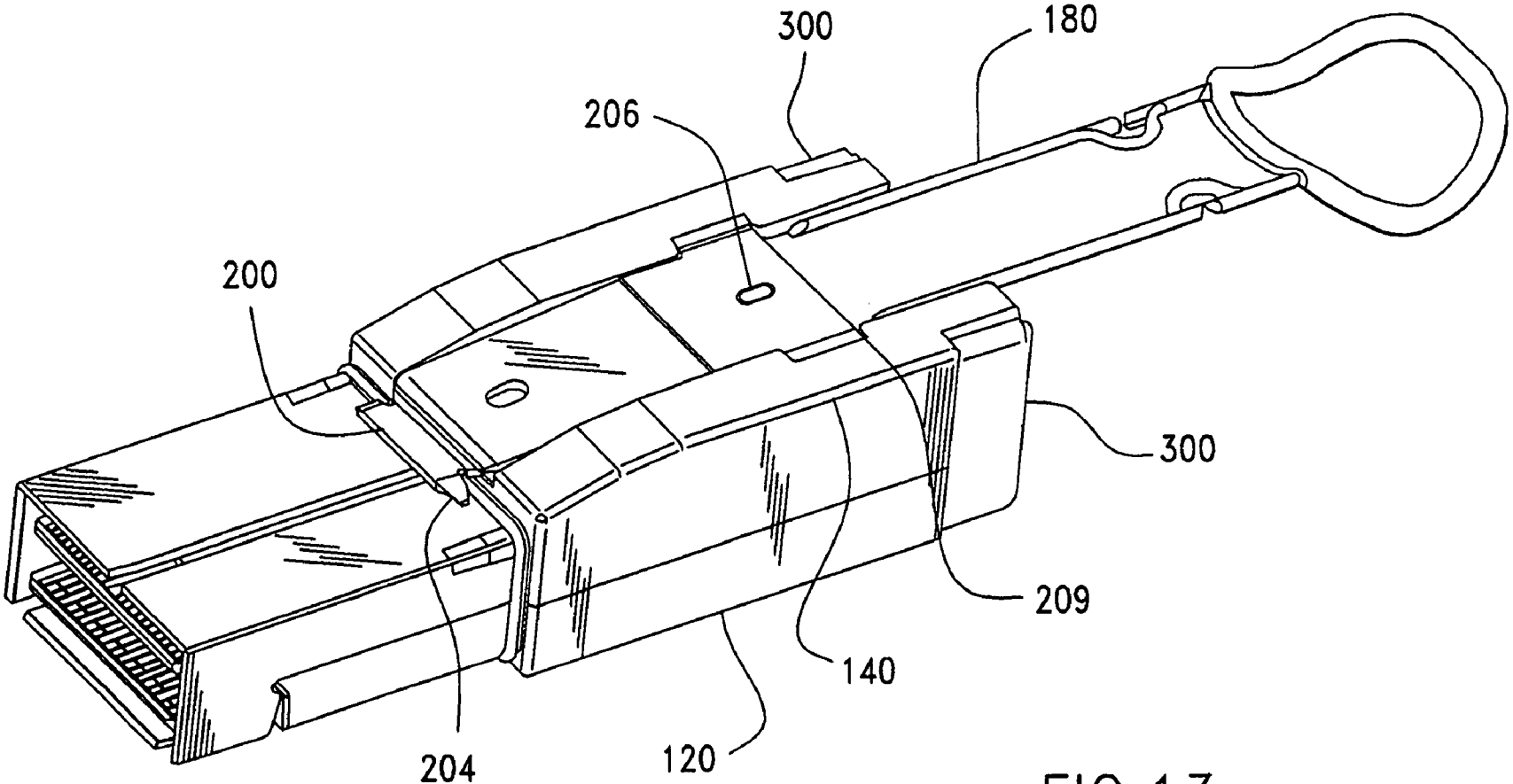
FIG. 13 illustrates a perspective view of an embodiment of a connector with an alternative method of construction.
Figure 14:
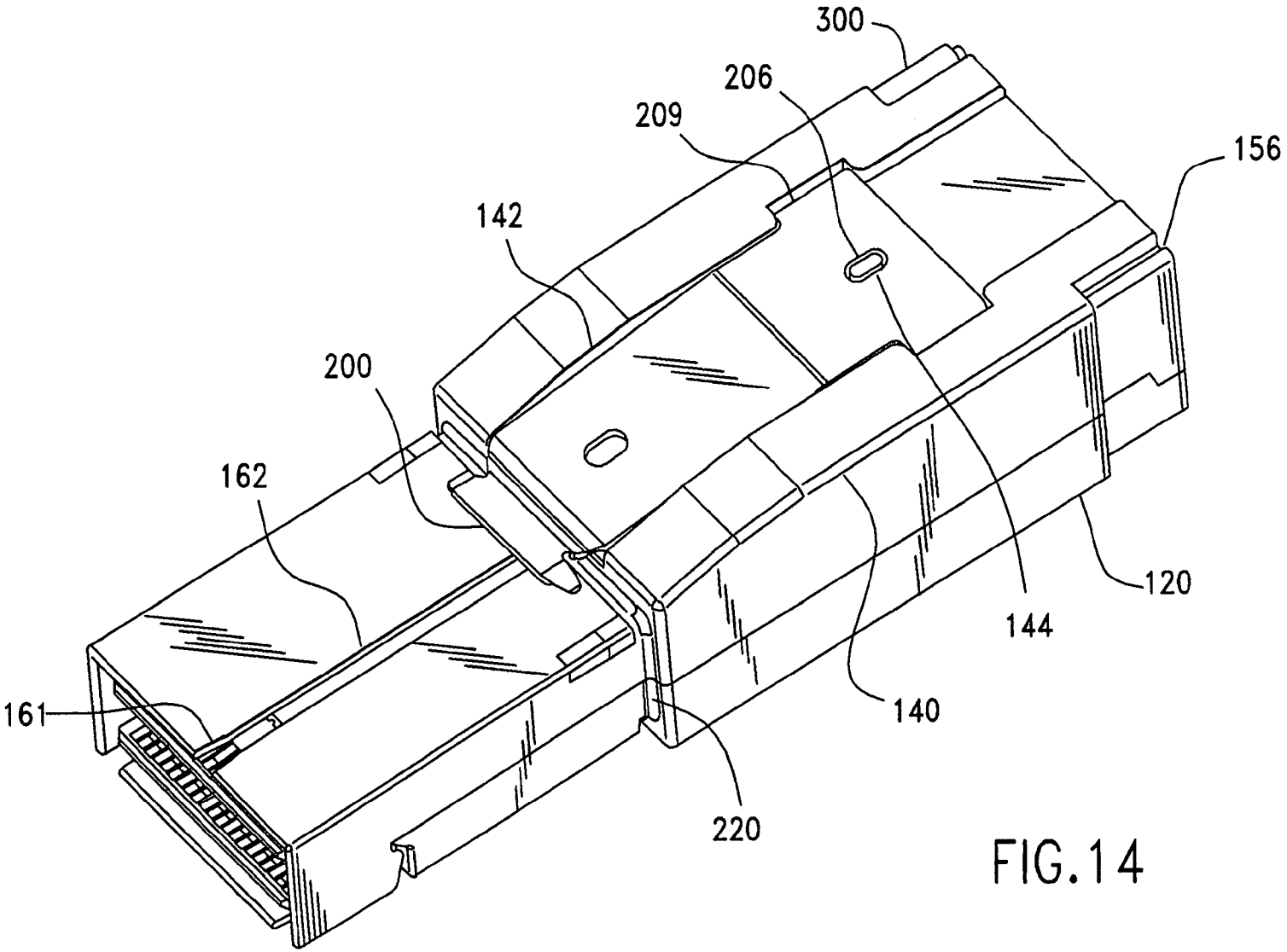
FIG. 14 illustrates a partial perspective view of the connector depicted in FIG. 13.
Figure 14A:
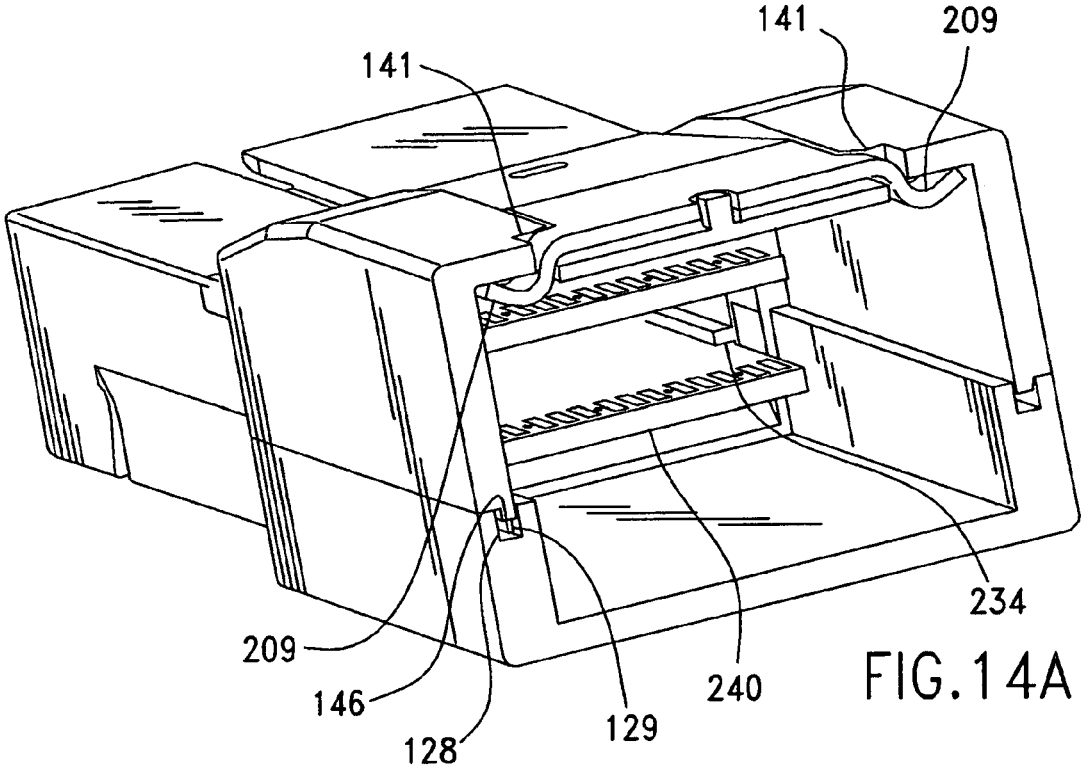
FIG. 14A illustrates a partial cross-section view taken along the line 14A-14A in FIG. 14.
Figure 15:
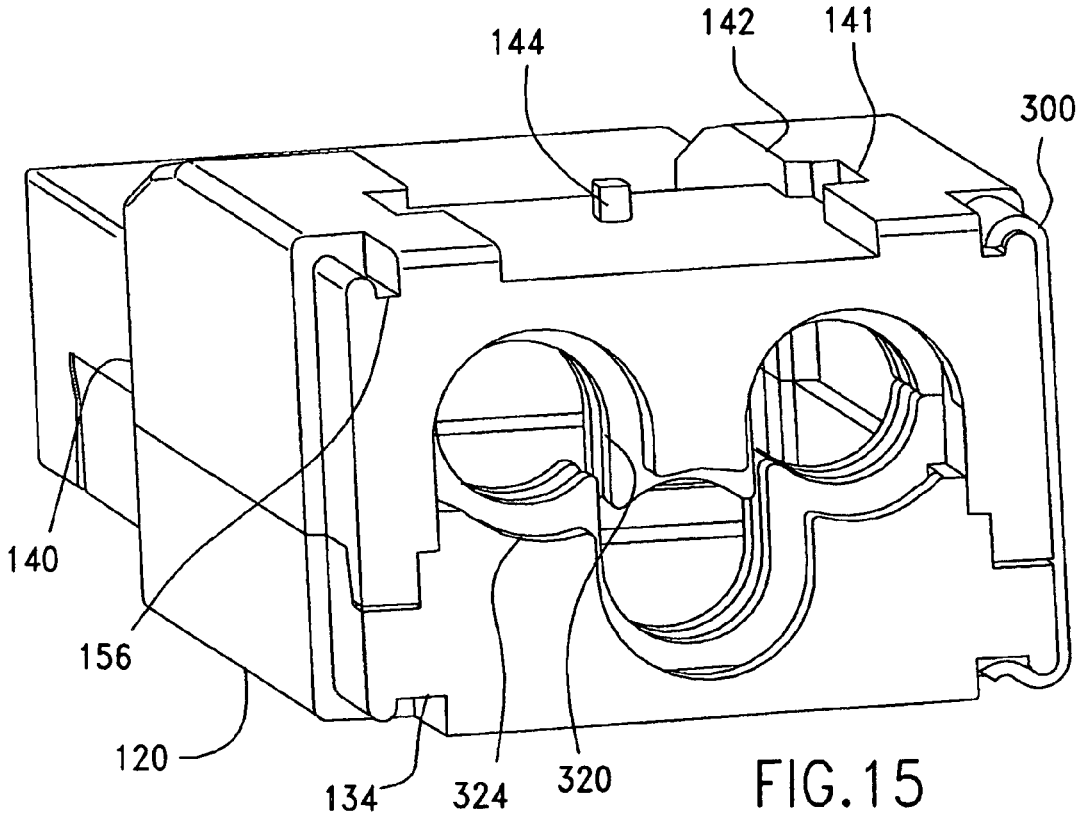
FIG. 15 illustrates a partial perspective view of the connector depicted in FIG. 13.
Figure 16:
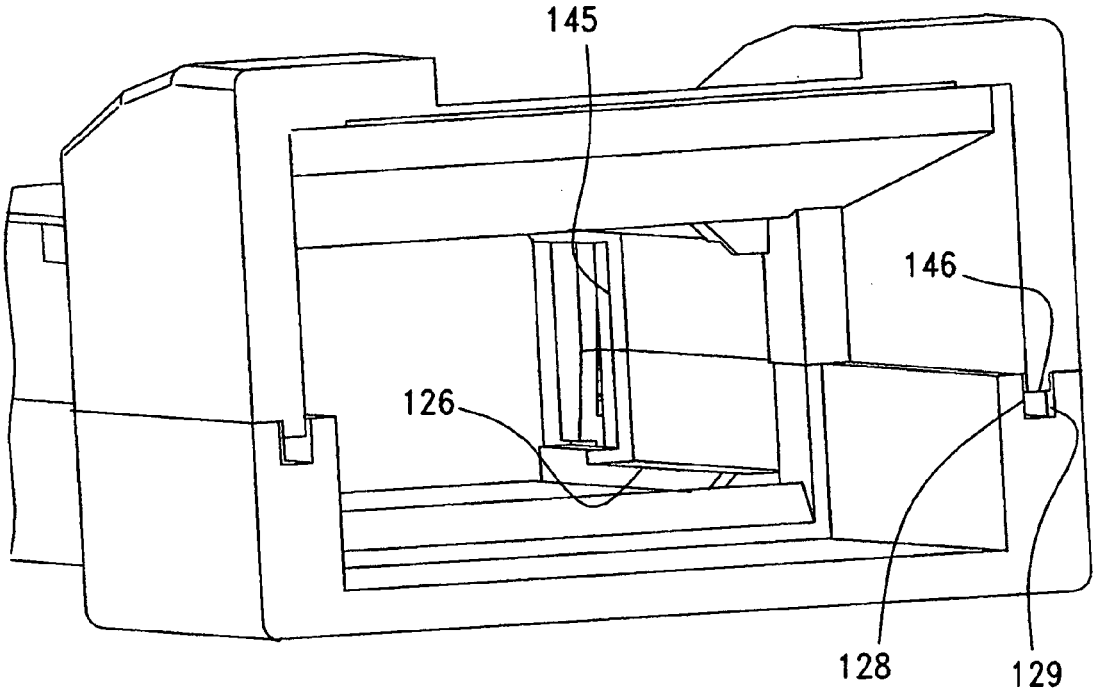
FIG. 16 illustrates a perspective cross-section view taken along the line 16-16 in FIG. 15.

FIGS. 13-15 illustrate an embodiment with a clip 300 that is used to secure the first and second housing 120, 140 together. The clip 300 engages a first recess 156 and a second recess 134 and is crimped into place so that the two housing are securely fastened together. As can be appreciated, the clip 300 may be included on both sides of the connector. If desired, the retaining member 200 may also be configured so that it is secured to the second housing 140 without the use of separate fasteners. In an embodiment the retaining member 200 may be secured by inserting wings 209 into receiving notches 141 so as to secure the pull tab 180 in position, as can be appreciated from the cross-section depicted in FIG. 14*a*. As depicted, the wings 209 are sufficiently flexible (in combination with the rest of the retaining member 200) so as to be inserted into the notches 141 without significantly plastically deforming while being strong enough to secure the pull-tab 180 in position.

Figure 17:
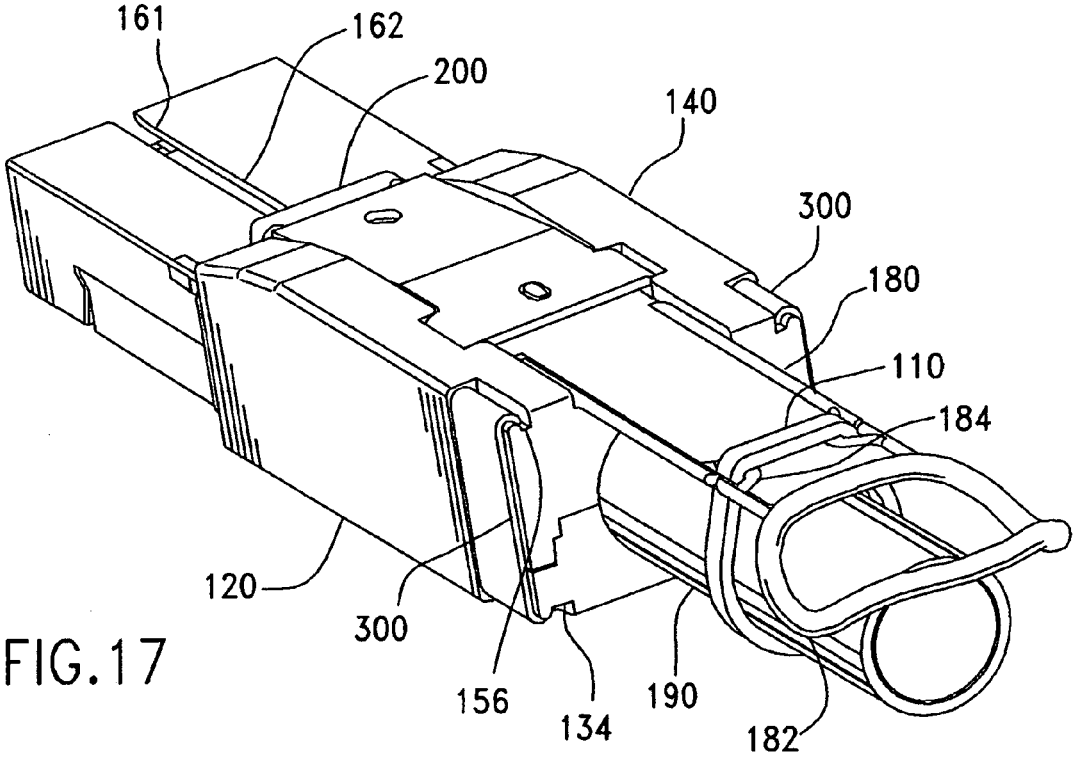
FIG. 17 illustrates a perspective view of an embodiment of a connector configured to be coupled to a single cable.
Figure 18:
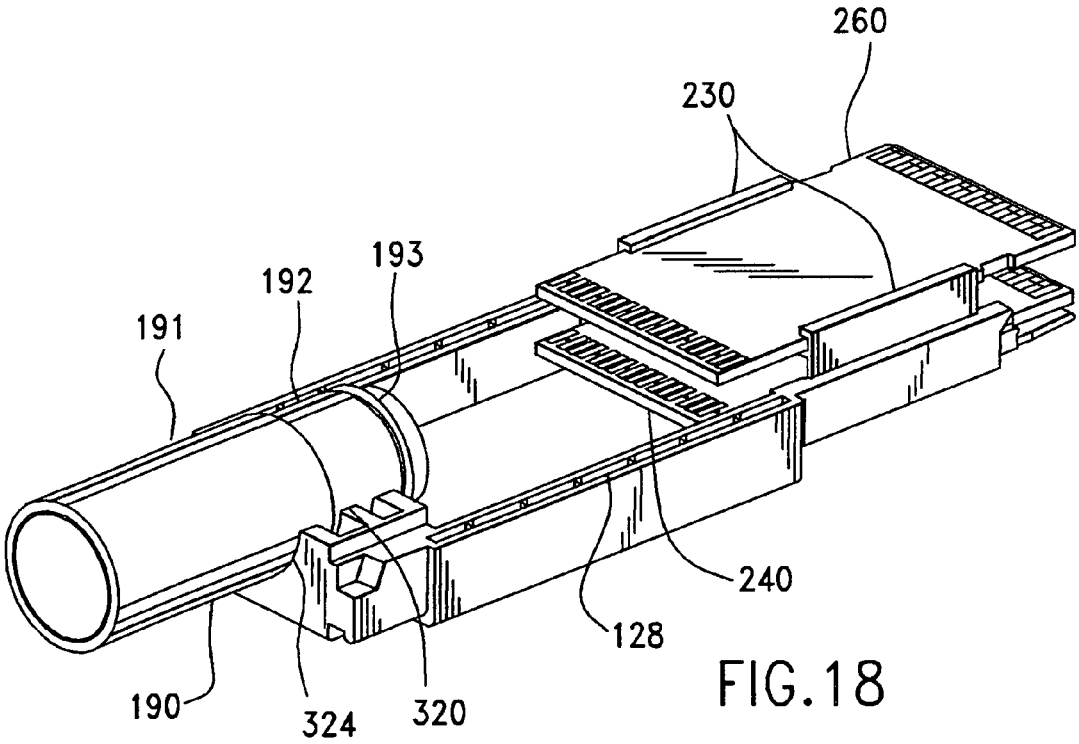
FIG. 18 illustrates a partial perspective view of the connector depicted in FIG. 17.
Figure 19:
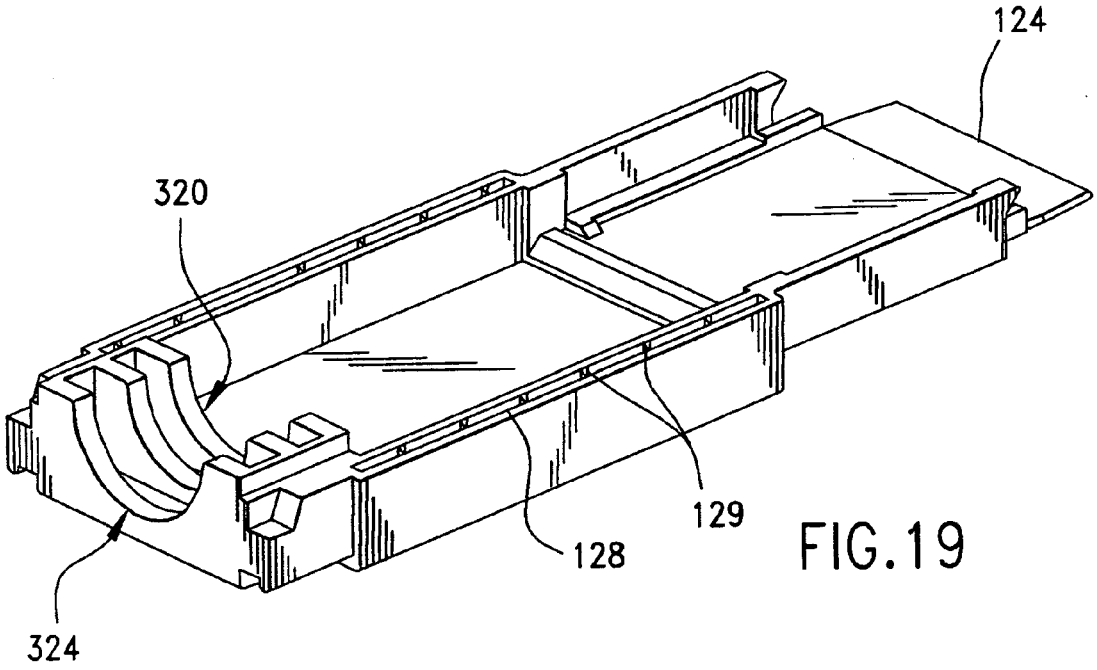
FIG. 19 illustrates a further simplified view of the partial connector depicted in FIG. 18.

FIGS. 17-19 illustrate an embodiment where a single cable is coupled to the housing. As can be appreciated, grouping the conductive elements in a single cable makes it simpler to route the cable, however the larger size may make it less flexible and will direct all the communication channels to a single point (versus three cables, for example, which would allows the signals to be split into three separate groupings). As with the three cable version discussed above, however, the shield portion may be secured by placing the ferrule 193 underneath the shield 192 so that the shield support 320 can securely grip and pinch the shield between the ferrule 193 and the shield support 320.

The single wire connector version may be coupled together with clips and crimping steps so as to avoid the use of additional fasteners, as depicted in FIG. 17, for example. It should be further noted that a combination of clips and fasteners may be used as desired for various configurations, including variations in the number of cables and/or when used with optical modules, and the selection of a design that is partially or completely crimped will depend on manufacturing preferences and labor costs. The benefit of using the wing insertion design (as discussed above with respect to FIGS. 13-14A) is the potential for a reduction in part numbers that was not previously possible while still providing an increase in the number of conductors in the desired connector space.

Figure 20:
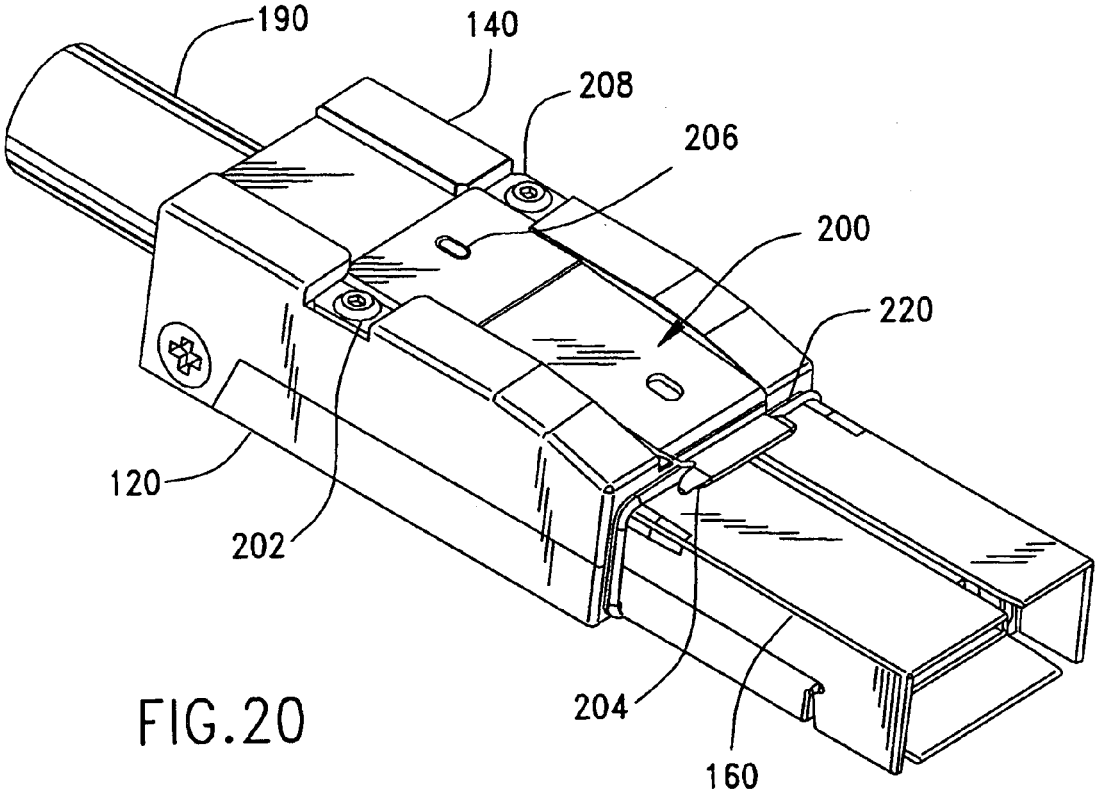
FIG. 20 illustrates a perspective view of another embodiment of a connector coupled to a single cable.

FIG. 20 illustrates an embodiment similar to the design depicted in FIGS. 17-19 but with fasteners used to couple the first and second housing 120, 140 together and to secure the retaining member 200 to the second housing 140. It should be noted that, as can be appreciated from FIG. 9, mounting the fastener 210 between the shield support 320 and the insulative support 322 helps minimize the space required while allow the fastener to avoid interfering with the cable being secured to the connector 100. This is also a benefit of the design depicted in FIG. 9.

Figure 6:
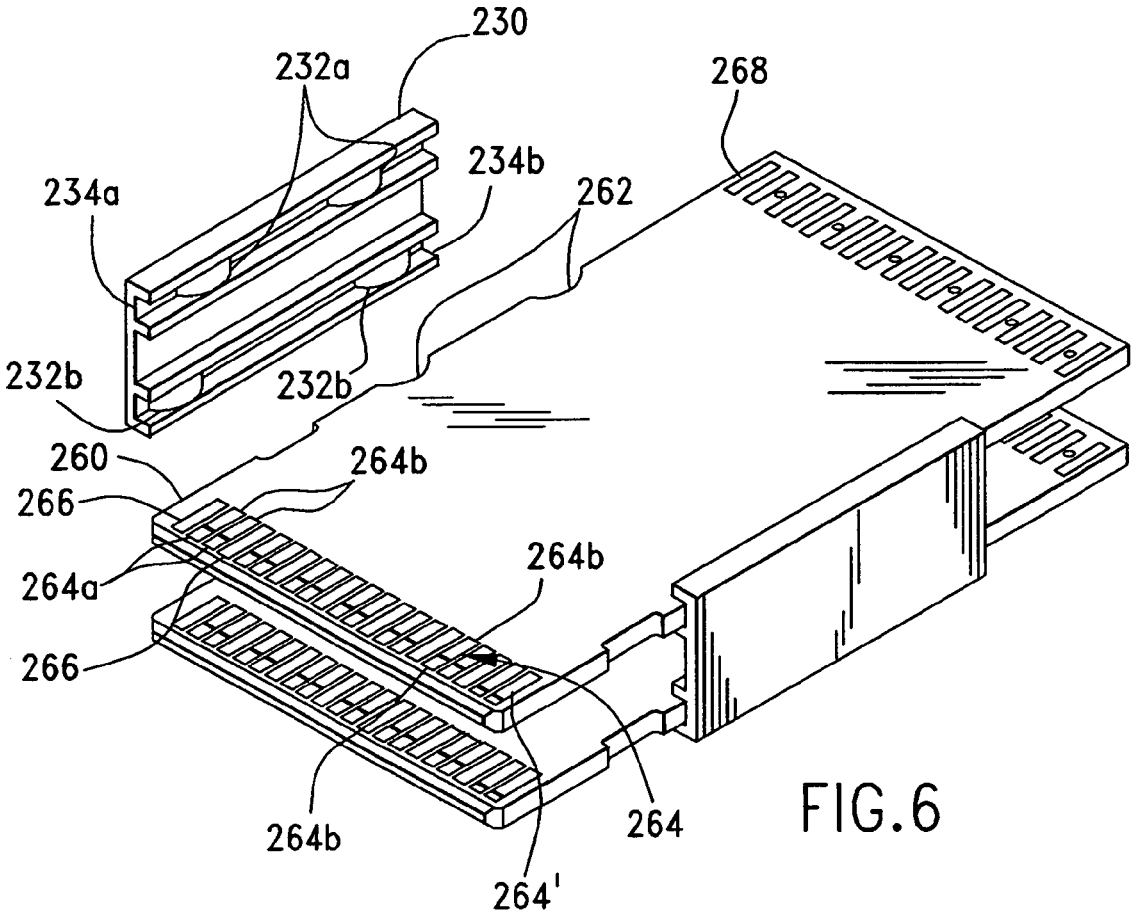
FIG. 6 illustrates a perspective partially exploded view of an embodiment of a circuit card support coupled to a circuit card.
Figure 7:
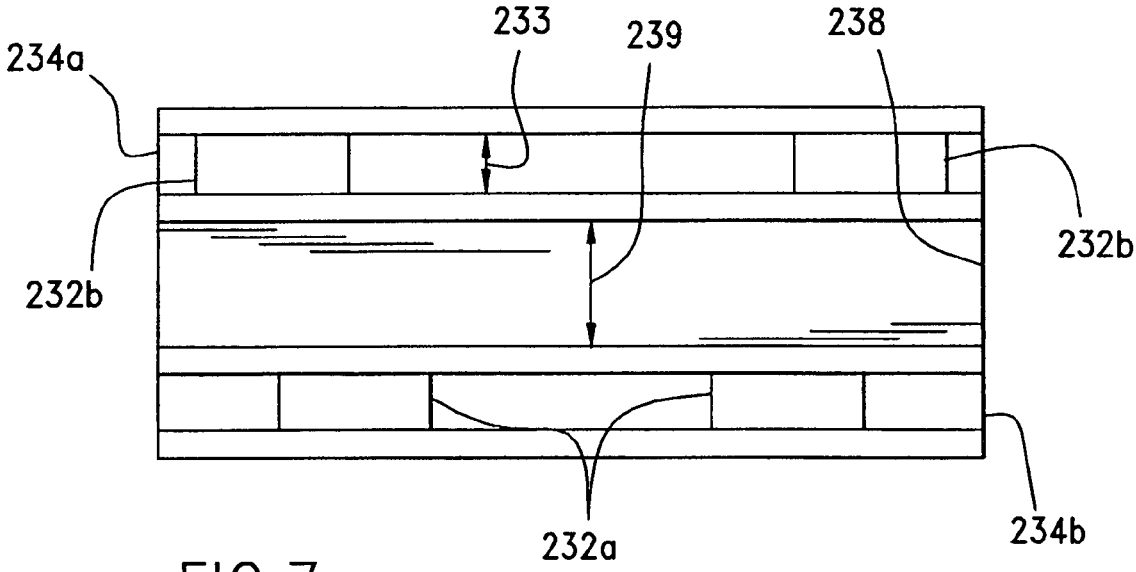
FIG. 7 illustrates an elevated side view of an embodiment of a circuit card support as depicted in FIG. 6.
Figure 8:
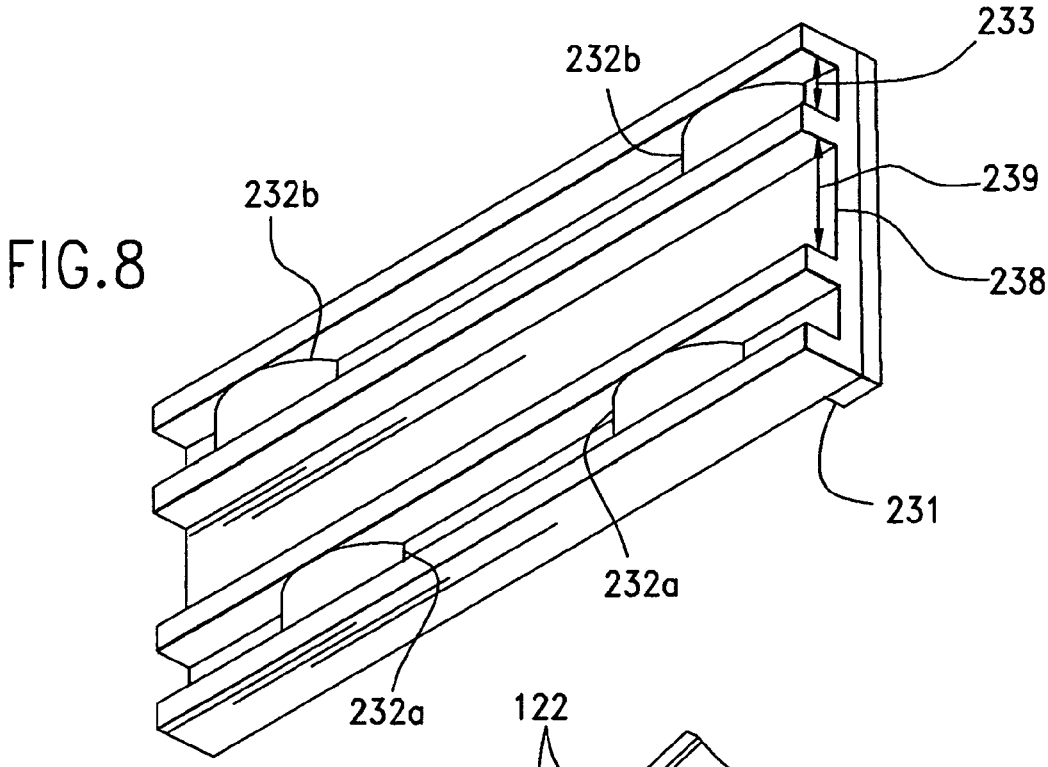
FIG. 8 illustrates a perspective of an embodiment of a circuit card support as depicted in FIG. 6.
Figure 10:
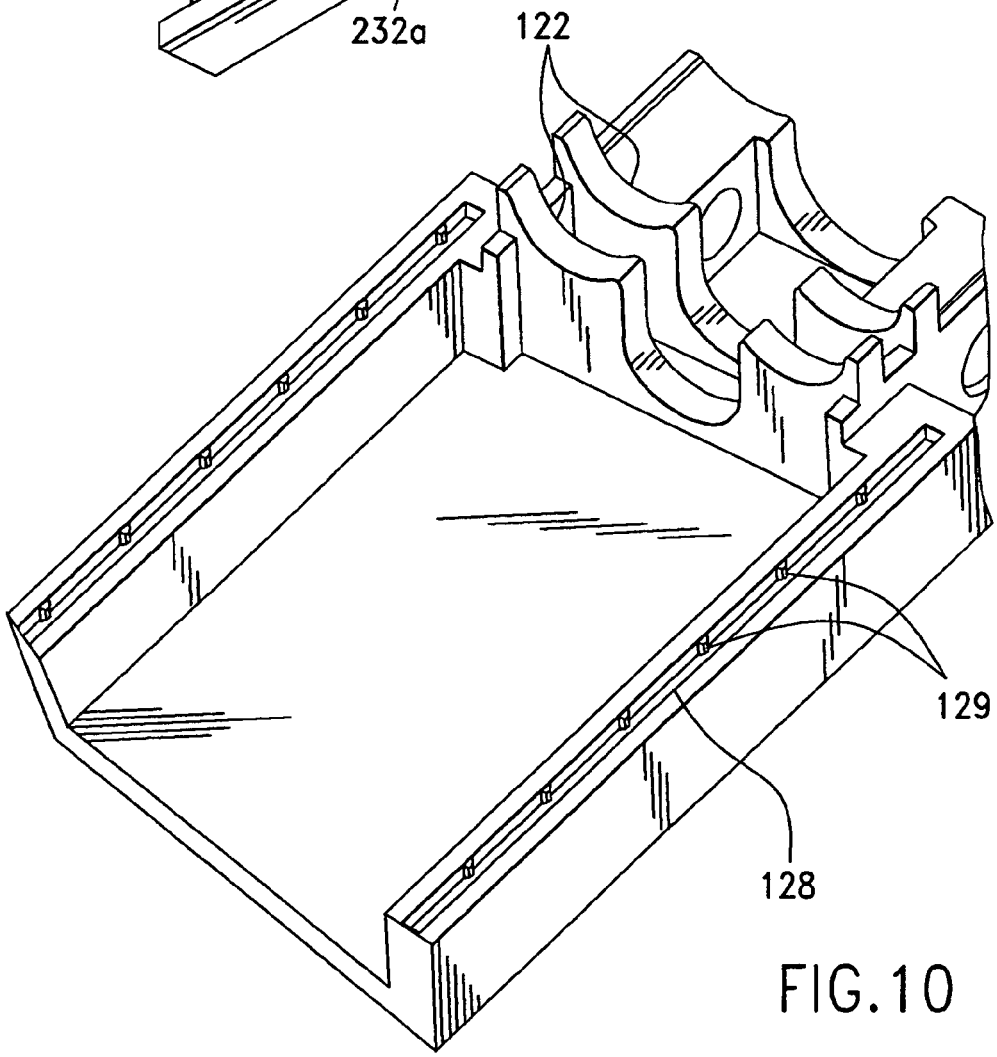
FIG. 10 illustrates an enlarged perspective view of a housing depicted in FIG. 5.
Figure 9:
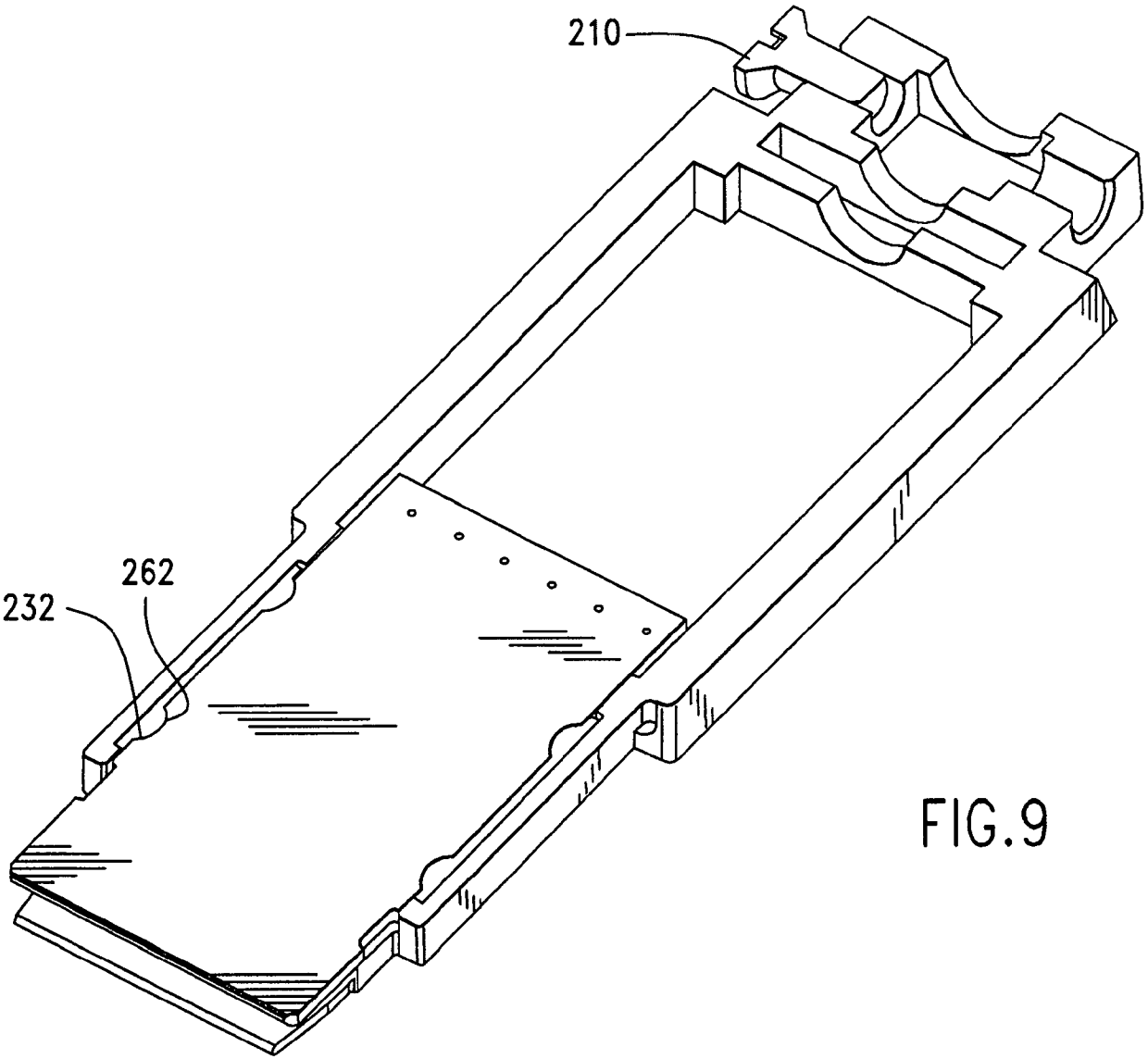
FIG. 9 illustrates a cross-section view taken along the line 9-9 in FIG. 5.
Figure 12:
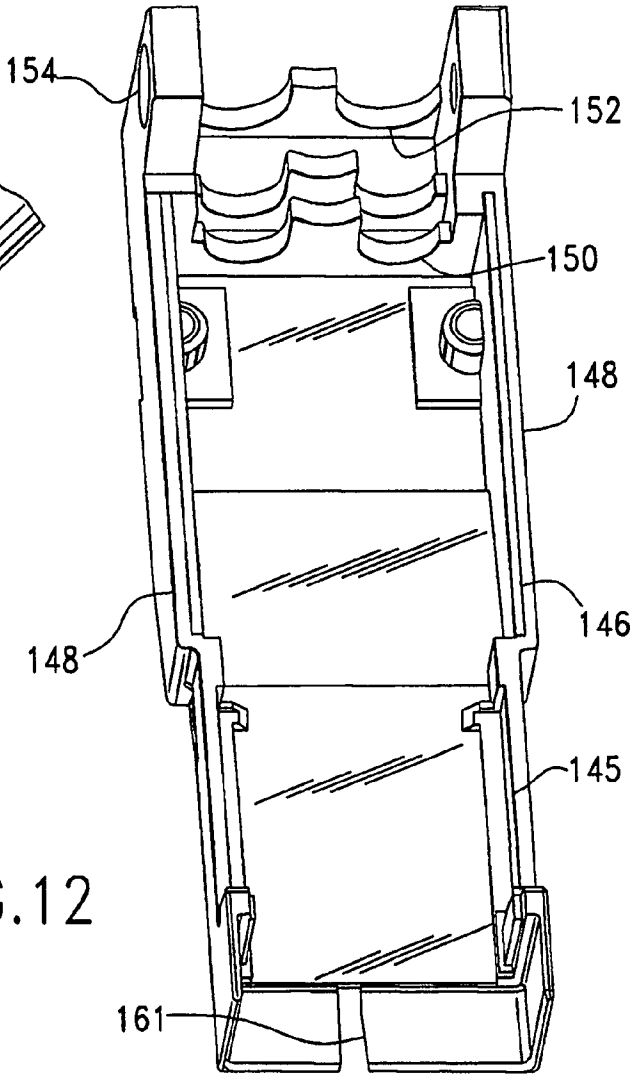
FIG. 12 illustrates another perspective view of the housing depicted in FIG. 11
Figure 11:
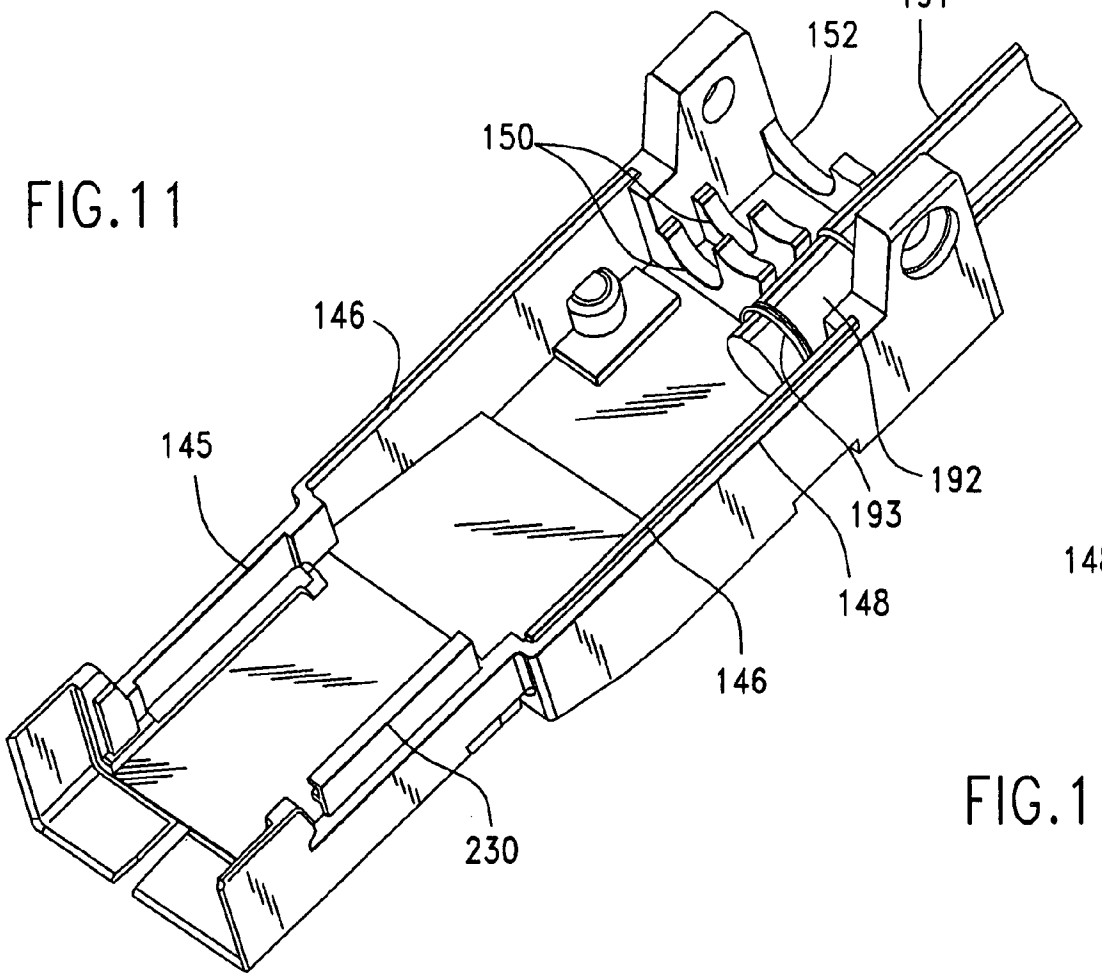
FIG. 11 illustrates a perspective view of an embodiment of a housing of the connector depicted in FIG. 1.

Looking again at FIGS. 6-8 (as well as FIGS. 14A and 21-22), additional features associated with the card support 230 are depicted. In particular, the card support 230 includes a first channel 234*a* and a second channel 234*b* that are configured to support the circuit cards 240, 260. The channels 234*a*, 234*b* are a distance 233 wide while a channel 238 is a distance 239 wide and the channel 238 separates the two channels 234*a*, 234*b*. While not required, in an embodiment the card support 230 is configured so that the distance 239 of the channel 238 is greater than 2.0 mm, which provides the advantage of ensuring sufficient distance between the two circuit cards while avoiding an extended wall thickness variation in the card support 230. As depicted in FIGS. 21-22, additional channels may be added so that three or more circuit cards are supported.

In certain configurations it may be desirable to control the orientation of the circuit cards with respect to each other (e.g., it may be desirable to control where each circuit card is positioned). Therefore, positioning elements 232*a* and 232*b* can be used. As can be appreciated, if the position elements 232*a* are spaced apart differently than positioning elements 232*b* and circuit card 240 and 260 are configured to only be inserted in one of the channels, the orientation of the circuit cards can be controlled. Similarly, positioning elements 332*a*, 332*b* and 332*c* can be arranged so as to ensure a particular circuit card can be positioned in the respective channels 334*a*, 334*b*, 334*c*.

It should be noted that the positioning elements 232*a* and 232*b* may be different so as to provide further polarizing functionality. In other words, circuit cards and the corresponding positioning elements may be configured so that a circuit card can be position only in one channel only in particular orientation and location. Furthermore, each circuit card can be configured the same (so that two or more circuit cards can be positioned interchangeably) or each circuit card can be configured differently so that there is only one possible configuration for the positioning two or more circuit cards in the card support. Thus, a high degree of flexibility can be permitted if desired while allowing for careful control of the position and orientation of each circuit card if desired. In addition, a further polarizing feature 231 may be provided on the card support 230 so that it can only be installed in one orientation (and potentially only on one side of the connector). Thus, the desired orientation of the circuit cards can be carefully controlled with respect to each other (e.g., skew can be controlled so the circuit cards are in planes that are substantially parallel) and the orientation of the circuit cards can be readily predetermined.

As can be appreciated from FIG. 6, the circuit card may be configured for higher speed performance. While not required, ground traces 266 and signal traces 264 can be configured for high speed. For example, the signal trace 264 can have a split-pad design with lead-in portions 264*a* and contact portions 264*b* separated by small gap. The contact portions 264*b* can be about 1.6 mm long, which with the depicted card support design, can be use in a high performance connector.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a first conductive housing with a first mating edge extending a first length, the first mating edge including a first elongated slot extending along a portion of the first length, the first elongated slot including a plurality of ribs;

a second conductive housing with an elongated shoulder configured to be inserted into the elongated slot, the elongated shoulder configured to fill a portion of the elongated slot so as to crush the plurality of ribs when the first and second housing are joined, wherein the first and second housing define an interior cavity; and a first and second circuit card positioned in the interior cavity, the circuit cards being spaced apart vertically and positioned in a substantially parallel manner, each of the circuit cards including a plurality of contact pads on a first end, the first ends being vertically aligned, the contact pads configured in operation to engage terminals in a corresponding connector.

2. The connector of claim 1, wherein the first housing further includes a second mating edge with a second elongated slot, the second elongated slot including a plurality of spaced-apart ribs and the second housing including a second elongated shoulder configured to be inserted into the second elongated slot.

3. The connector of claim 2, wherein the plurality of ribs in the first and second elongated slots are positioned on alternating sides of the elongated slots.

4. The connector of claim 3, wherein the plurality of ribs are spaced apart not more than 3 millimeters.

5. The connector of claim 1, wherein the plurality of ribs are spaced apart so as to be separated a distance of about two to six millimeters between adjacent ribs.

6. The connector of claim 5, wherein elongated slot has a width and the plurality of ribs extend a distance into the elongated slot that is about ten to 26 percent of the width.

7. The connector of claim 1, wherein the circuit card is a first circuit card, the connector further comprising at least one additional circuit card.

8. A connector, comprising:

a two-piece conductive housing defining an internal cavity, the two-piece housing including a first mating intersection between the two pieces, the first mating intersection including a first side and a second side, wherein the first side includes a first mating edge with a first elongated slot and the second side includes a first elongated shoulder configured to be inserted into the first elongated slot;

at least one crushed rib positioned between the first elongated slot and the first elongated shoulder; and a circuit card positioned at least partially in the internal cavity and supported by the housing, the circuit card including a plurality of contact pads on a first end.

9. The connector of claim 8, wherein the two-piece housing further include a second mating intersection with a third side and a fourth side, wherein the third side includes a second mating edge with a second elongated slot and the fourth side includes a second elongated shoulder configured to be inserted in the second elongated slot, the connector further including at least one crushed rib between the second elongated slot and the second elongated shoulder.

10. The connector of claim 9, wherein the at least one crushed rib in the first elongated slot and the at least one rib in the second elongated slot are each a plurality of ribs spaced apart so as to be not more than about six millimeters apart.

11. The connector of claim 10, wherein the plurality of ribs are positioned on alternate sides of the respective first and second elongated slot and are positioned not more than three millimeters apart.

12. The connector of claim 9, wherein the circuit card is a first circuit card, the connector further comprising at least a second circuit card, the first and at least second circuit card being arranged in a substantially parallel alignment.

13. The connector of claim 9, further comprising a plurality of fasteners configured to couple the two-piece housing together.

14. The connector of claim 13, wherein the two-piece housing includes a first side with a latch groove and further includes a second side and opposing third side, wherein the plurality of fasteners are positioned on the second and opposing third side.

15. A connector, comprising:

a first and second conductive housing coupled together and defining an internal cavity and a plug portion, the first and second housing collectively having a first width and a first height about the internal cavity and the plug portion having a second width and a second height, one of the first width and first height being greater than a corresponding second width or second height of the plug portion, wherein one of the first and second housing includes a first mating edge with a first elongated slot, and the other of the first and second housing include a first elongated shoulder inserted in the first elongated slot;

a plurality of crushed ribs positioned between the first elongated shoulder and the first elongated slot; and at least one circuit card positioned in the internal cavity of housing and extending into the plug portion.

16. The connector of claim 15, wherein one of the first and second housing includes a second mating edge with a second elongated slot and the other of the first and second housing includes a second elongated shoulder inserted into the second elongated slot, the connector further comprising a plurality of crushed ribs that are spaced apart and are positioned between the second elongated shoulder and the second elongated slot.

17. The connector of claim 15, wherein the plurality of ribs are positioned not more than six millimeters apart.

18. The connector of claim 15, wherein the first mating edge does not extend into the plug portion and the at least one circuit card extends partially out of the plug portion and the plurality of crushed ribs are positioned on alternating sides of the first elongated slot.

19. The connector of claim 18, wherein the elongated slot has a width and, prior to insertion of the elongated shoulder into the elongated slot, the plurality of ribs extends into the elongated slot a distance that is between about ten to twenty six percent of a width of the elongated slot.

20. The connector of claim 15, wherein the first and second housing are coupled together with a plurality of clips that crimp the first and second housing together.

21. The connector of claim 15, wherein one of the first and second housing includes a first face, a second face and a third face, the first face including a latch groove positioned thereon, wherein the first and second housing are coupled together with a plurality of fasteners and at least one of the plurality of fasteners is mounted on each of the second and third face.

22. The connector of 15, wherein the connector is configured to engage a plurality of cables.

* * * * *